United States Patent [19]

Garate

[11] 3,958,793

[45] May 25, 1976

[54] TRANSMISSION JACK

[76] Inventor: Julian Garate, 855 Marietta Way, Sparks, Nev. 89431

[22] Filed: Feb. 19, 1975

[21] Appl. No.: 550,990

[52] U.S. Cl. ..... 254/10 B; 254/133 R

[51] Int. Cl.[2] ..... B66F 5/04

[58] Field of Search ..... 254/8–10, 254/133, 134; 214/1 D

[56] References Cited

UNITED STATES PATENTS

| | | | |
|---|---|---|---|
| 2,611,579 | 9/1952 | Guzey et al. | 254/8 B |
| 2,785,807 | 3/1957 | Prowinsky | 254/9 R |
| 2,806,613 | 9/1957 | Johnson | 254/8 B |
| 2,906,497 | 9/1959 | Wolf | 254/10 B |
| 3,758,076 | 9/1973 | Tranchero | 254/8 R |

FOREIGN PATENTS OR APPLICATIONS

| | | | |
|---|---|---|---|
| 653,079 | 11/1937 | Germany | 254/8 R |

*Primary Examiner*—Al Lawrence Smith
*Assistant Examiner*—Robert C. Watson
*Attorney, Agent, or Firm*—Herbert C. Schulze

[57] ABSTRACT

This is a jack for the hoisting of automotive transmissions and the like into place under a vehicle and for the removal of the same from beneath the vehicle when required for replacement or repairs. This jack is particularly distinguished by a fully adjustable cradle arrangement with a safety locking device so as to adjust to all transmissions and to varying angles of repose within the vehicle.

1 Claim, 3 Drawing Figures

TRANSMISSION JACK

CROSS REFERENCE TO RELATED PATENT APPLICATIONS

There are no related patent applications filed by me.

BACKGROUND OF THE INVENTION

1. Field of the Invention

This invention is in the general field of lifting devices, and is more particularly drawn to an adjustable jack for the lifting or lowering of transmission beneath vehicles wherein a particular feature is complete adjustability with varying safety features, and it features a unique adjustable chain cradle.

2. Description of the Prior Art

There is much prior art in the field of lifting devices, and particularly in the field of jacks, including jacks adaptable for use as transmission jacks. I am familiar with such jacks as exemplified by U.S. Pat. No. 1,819,378; U.S. Pat. No. 2,785,807; U.S. Pat. No. 2,583,114; U.S. Pat. No. 2,906,497, and similar lifting devices.

Certain of the hydraulic lifting principles disclosed in this prior art are well known, however the unique adjustability and versatility of the adjustable chain cradle with fully pivoting platform is unique and there is not prior art anticipating the same.

SUMMARY OF THE INVENTION

One of the most difficult, and frequently dangerous, tasks facing automotive mechanics is the removal and reassembly of transmissions in a vehicle chassis and in appropriate connection with the other portions of the power train.

Transmissions are generally heavy and clumsy and are usually located in relatively inaccessable places beneath the vehicle. Assuring the retention and proper lifting and lowering of a transmission during work on this portion of the vehicle is most important and most difficult.

There have been many transmission jacks designed, and each has a number of deficiencies.

The most important factors, which have heretofore been impossible of complete attainment, are the feature of lowering to virtual contact with the ground or working surface, as well as a maximum elevation, and complete adjustability to the individual transmission and the individual vehicle and terrain characteristics.

There have been various screw adjustments and the like utilized for attempted universal adjustability. Such arrangements, however, have never been totally satisfactory and are frequently difficult of adjustment when being worked upon by a mechanic in difficult positions beneath a vehicle.

Likewise, even in the lifting, it is frequently found that tilting will occur at different elevations.

I have solved the problems inherent in previous transmission jacks by the use of a pair of chains which form a cradle and are adjustable link by link through a slot arrangement in holding brackets, which in themselves are slideable so as to provide a wide or a narrow overall cradle.

I have provided a unique safety chain which encircles the top of the transmission when in place on the jack and thus prevents any possible disturbance due to unforeseen slippage or other causes.

I have also provided a tilting platform which holds the cradle so as to accomodate for differences in the terrain on which a vehicle may be located during the transmission work or in order to accommodate to an unusual plane or inclination of a transmission as actually mounted within the vehicle.

Further than this, my device has provided a unique parallelogram arrangement for lifting arms so that the platform and cradle remain at a constant angle during the entire operation of lifting or lowering and I have provided a unique safety ratchet arrangement so that if the hydraulic lifting arrangement should fail that there will not be a sudden dropping of the transmission.

I have combined all of this with a special relationship of the lifting arms to the carriage such that I am able to achieve a very low profile of the entire jack and particularly the lifting portion so that it is possible to work under very low transmissions without raising or otherwise altering the position of the vehicle itself.

It is an object of this invention to provide a transmission jack having a very low profile so as to be able to be placed beneath virtually any vehicle on virtually any surface;

Another object of this invention is to provide a cradle for a transmission upon a transmission jack platform such that the transmission may be adjustably located and safely held against slippage;

Another object of this invention is to provide a transmission jack with a safety device to prevent unexpected lowering of the jack.

The foregoing and other objects and advantages of this invention will be clear to those skilled in the art upon reading the following description of a preferred embodiment in conjunction with the drawings.

DESCRIPTION OF A PREFERRED EMBODIMENT

Figure 1:
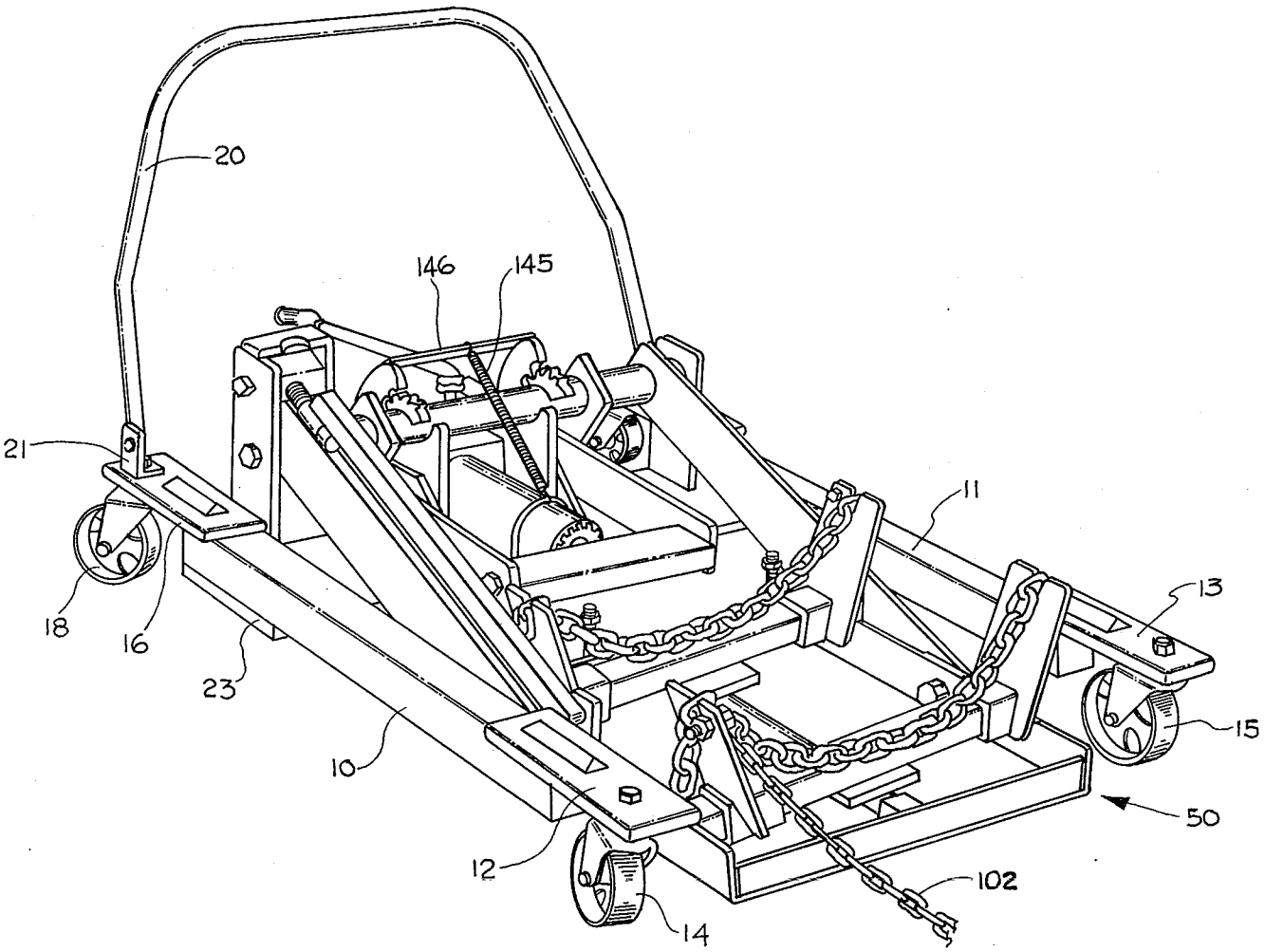
FIG. 1 is a perspective from the front and one side of a preferred embodiment of this invention.
Figure 2:
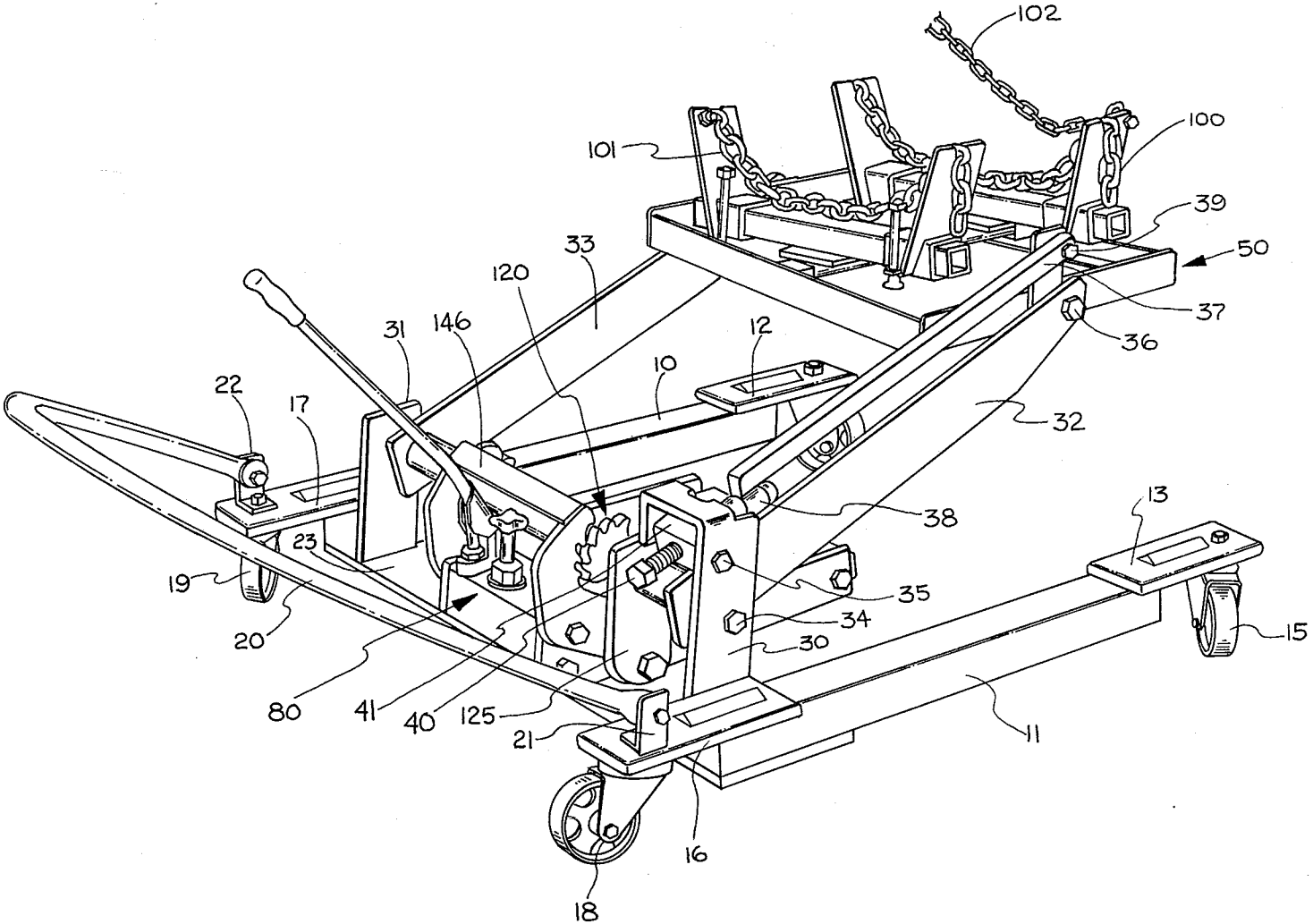
FIG. 2 is a perspective from the rear and the same side as in FIG. 1 of the same device; and, FIG. 3 is an exploded view of the device shown in FIGS. 1 and 2.
Figure 3:
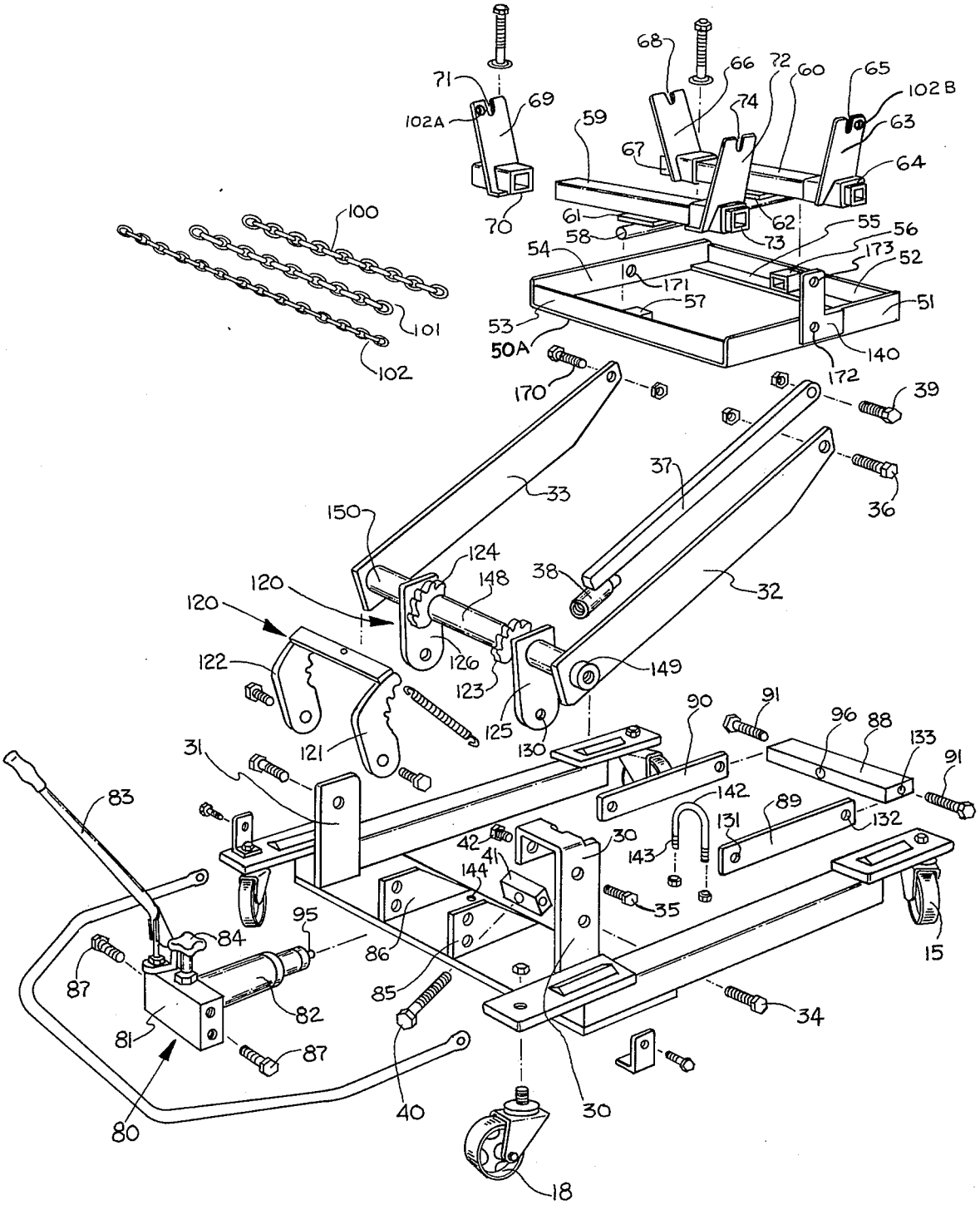

In this particular invention, the figures shown are best viewed together, since the interaction and relationship of the items constituting the device is best shown in this manner.

The device is seen to consist of a basic frame arrangement constituting essentially a "U" shaped frame of members 10, 11, and 23. This frame is supported on wheels 14, 15, 18, and 19, appropriately mounted upon brackets 13, 16, 17, and 12, welded, or otherwise suitably attached, to the basic frame hereinbefore described. A cradle, generally 50, is carried upon a pair of arms 32 and 33 in turn mounted upon a shaft arrangement 148.

The cradle 50 is generally composed of a framework of rectangular configuration 51, 52, 53, and 54, wherein the edges 51 and 54 are turned up edges of the platform piece 50A. The elements 53 and 52 are each basically in the form of angle iron (the other leg of the element 52 being shown by the numeral 55). It is understood that a similar leg will exist upon the side 53.

A pair of tubular members 56 and 57 are welded or otherwise suitably attached in the positions indicated. As shown in this illustration they have a square configuration although round tubing could also be used. A shaft 58 mount within the two tubular elements 56 and 57 in a pivotal manner. A shaft 58 has welded or otherwise suitably attached to it plates 61 and 62 carrying respectively reactangular cross section tubular members 59 and 60.

For rectangular cross section tubular members 61, 64, 70 and 73, are so provided with holding brackets 66, 63, 69, and 72, each of which has a slot in its upper portion as indicated at 65, 68, 71, and 74, as to accommodate a chain as will be hereinafter described. The four rectangular sections 64, 67, 73, and 70, slip over the ends of the two members 59 and 60 in the manner indicated. These members slide toward or away from each other in pairs as will be apparent and when a weight is placed upon the upstanding members, a binding action is created such that slippage is then stopped. This principle is known to those skilled in the art.

The chains 100 and 101 are held by the slots 65, 68, 71, and 74 by means of the cross links on the chains preventing movement once adjusted into a particular position.

Chain 102 is fastened by bolts or the like to the holes 102A and 102B by bolts or the like as indicated. This chain may then be wrapped around a transmission resting in position upon upon chains 100 and 101 and thus be held against slippage from some unexpected occurrence. The basic cradle is mounted upon arms 32 and 33 by bolts 36 and 170 through holes 171 and 172. The bracket 140 has an additional hole 173 which is connected to the arm 37 by means of bolt 39. The arms 32 and 33 are connected to shaft 148 at its ends 149 and 150 by means of bolts through the hole in the upper portion of bracket 31 and bracket 30. Bracket 30 is seen to include a U shaped upper portion with additional bolt 35 and 42 holding bracket 41. Bracket 41 accommodates screw 40 which then enters the threaded portion of boss 38 for adjustment of the angle of repose of the cradle 50.

The shaft 148 is provided with two arms 125 and 126, and with two ratchet arrangements 123 and 124 as indicated. The element 120 composed of arms 121 and 122 with a cross connecting brace and having teeth matching the ratchet elements 123 and 124 is provided. This is fastened to the upper holes of brackets 85 and 86 by bolts as indicated.

A spring 145 is fastened as particularly indicated in FIG. 1 to hold the ratchet arrangement in contact so that in case of slippage at any partucylar point the platform 50 will not drop unexpectedly. The arms 89 and 90 are provided with holes as indicated, particularly holes 131 and 132 on arm 89 and similar holes (unnumbered) on arm 90. Through the hole 132 and its campanion hole, the block 88 is fastened by bolts 91 into threaded openings therein 133.

The adapter hole 96 is so positioned as to align with and to come into contact with the end 95 of the hydraulic ram arrangement 82. The arms 89 and 90 are fastened through their holes 131 and its companion hole to arms 125 and 126 through holes 130 and its companion hole.

The hydraulic ram arrangement is fastened by block 81 and appropriate bolts 87 to the holes in brackets 85 and 86.

When the hydraulic ram 82 is activated by use of the handle 83, the oil pressure forces the ram 95 forward and thus swings the parallel arms 32 and 33 in an upward direction through the connection to the arms 125 and 126. U-bolt 142 is fastened to the hydraulic cylinder and provides further support for it by the two ends 143 and the other end, unnumbered, through holes 144 and another hole not shown in the plate 23. The U-bolt also acts as an anchor for the spring 145.

After the mechanism has been advanced to a desired height, it may be lowered by opening the valve 84 which allows fluid to run out from the ram 82 and into the pump which is located upon the end of the block 81 and is of detail known to those skilled in the art, and which is activated by handle 83.

When the valve 84 is opened the ratchet arrangement 120 will keep the transmission platform in the elevated position until it is manually pulled to the rear and out of engagement of the various like teeth. Thus safety is always assured since it is necessary to manually disengage the ratchet arrangement prior to any intended lowering.

A handle 20 is provided by a pivotal arrangement on brackets as indicated at 21 and 22 so that the device may be moved about as desired and the handle dropped out of the way when not wanted.

In practice, the chains 100 and 101 are adjusted by moving their linkage through the slots in the brackets until appropriate links has been achieved. The device is then raised into position and contact with a transmission and for use as desired.

When the device is moved about, the chain 102 is fastened over the top of the transmission and holds it firmly in place.

While the embodiment of this invention shown and described is fully capable of achieving the objects and advantages desired, it is to be understood that the embodiments so shown has been for purposes of illustration only and not for purposes of limitation.

I claim:

1. A transmission jack comprising: (1) Two elongated side frame elements at a spaced distance from one another; (2) Four wheels, one attached adjacent each end of each of said elongated frame members; (3) A third frame member attached to one end of each of said elongated frame members forming, with said elongated frame members an essentially "u" shaped frame; (4) Handle means pivotally attached to said elongated frame members adjacent the end thereof to which the third frame member is attached; (5) A pair of upright brackets attached to said third frame member, one of each being adjacent each of said elongated side frame members; (6) A rotatably mounted shaft extending between said two upright members; (7) A pair of arms mounted upon said rotatably mounted shaft extending therefrom in a parallel relationship to said side frame members and away from the said third frame member; (8) Hydraulic pump means attached to said third frame member; (9) Means attached to said rotatably mounted shaft activated by a hydraulic cylinder, said means being suitable to rotate said shaft; (10) Means connecting said hydraulic pump and said hydraulic cylinder; (11) Ratchet means attached to said rotatably mounted shaft in such manner as to prevent counter rotation thereof; (12) Rectangular platform means attached to the ends of said arms depending from said rotatable shaft at the ends opposite said rotatable shaft; (13) A pair of chain holding bracket means mounted upon said platform; (14) A chain adjustably mounted between each pair of said chain holding bracket means; (15) A bracket means; adjustably mounted between diagonally opposed ends of said two chain holding bracket means; (16) An adjustment arm located in parallel relationship with one of said arms extending from said shaft, said adjustment arm being attached to one of said upstanding brackets attached to said third frame member, the other end being attached to a bracket fastened to said platform; and means attached to said parallel arm for adjusting the distance therefrom from said bracket attached to said third frame member.

* * * * *